United States Patent [19]

Matern

[11] Patent Number: 4,974,806

[45] Date of Patent: Dec. 4, 1990

[54] FLEXIBLE DISHWASHING ACCESSORY

[76] Inventor: Stephen Matern, 1013 Floret La., #14T, Midvale, Utah 84047

[21] Appl. No.: 348,513

[22] Filed: May 8, 1989

[51] Int. Cl.[5] ..... B65D 63/00

[52] U.S. Cl. ..... 248/499; 211/13

[58] Field of Search ..... 211/183, 181, 82, 83, 211/84, 89, 41, 74, 13; 134/137, 135, 156; 312/270, 271, 272; 248/499, 500, 505; 24/300, 301, 265 R

[56] References Cited

U.S. PATENT DOCUMENTS

| | | | |
|---|---|---|---|
| 1,379,605 | 5/1921 | Allen | 211/31 |
| 1,503,298 | 7/1924 | Campbell | 211/31 |
| 2,328,474 | 8/1943 | Lewis | 24/300 |
| 2,728,058 | 12/1955 | Phalen | 248/499 X |
| 3,294,273 | 12/1966 | Ettlinger | 134/137 X |
| 4,108,342 | 8/1978 | Riva | 248/499 X |
| 4,559,677 | 12/1985 | Tracy | 248/499 X |

FOREIGN PATENT DOCUMENTS

| | | | |
|---|---|---|---|
| 1028058 | 5/1953 | France | 248/499 |
| 1146490 | 11/1957 | France | 248/499 |
| 480123 | 4/1953 | Italy | 248/499 |
| 565482 | 11/1944 | United Kingdom | 248/499 |
| 779944 | 7/1957 | United Kingdom | 248/499 |
| 984987 | 3/1965 | United Kingdom | 248/499 |

*Primary Examiner*—J. Franklin Foss

*Attorney, Agent, or Firm*—Thorpe, North & Western

[57] ABSTRACT

A flexible dishwashing accessory having elongate flexible cords attached at their ends to attachment members which in turn attach the accessory to a rack such as is used for cleaning, rinsing, drying or storing eating or cooking utensils. The accessory is used by placing utensils in contact with at least one flexible cord such that the utensil stretches the cord to create a pressure on the utensil sufficient to hold it in place when subjected to jets of water or air such as are generated by dishwashing machines or the like. The attachment member may be attachable to the rack by means of a hook, or may contain notches which secure it to the rack. Alternatively, the flexible cord may be attached directly to the rack and secured in place by the attachment member.

13 Claims, 3 Drawing Sheets

FLEXIBLE DISHWASHING ACCESSORY

BACKGROUND OF THE INVENTION (1) Field of the Invention

This invention relates to a device useful for securing objects in a container. More particularly, this invention relates to a dishwashing accessory useful for securing eating and cooking utensils in an open mesh rack.

(2) Background of the Invention

The advent of automatic dishwashing machines has greatly simplified the chore of cleaning cooking and eating utensils. However, because of the high velocity jets of water and air commonly used in such dishwashing equipment to clean the dishes, many utensils which are extremely light in weight and/or fragile in nature, cannot be effectively cleaned because of their tendency to be displaced, flipped over, or even tossed around and damaged by these high velocity jets of water and air. There have been several attempts to solve this problem, none of which has been completely successful.

One method of preventing movement of utensils in a dishwashing machine during its washing cycle has been to modify the design of the plastic or wire mesh which comprises the dish rack in which the utensils are placed. With this method, the rack is formed so that utensils can be wedged in between structural elements which make up a portion of the rack. Securing utensils in the rack relies on either the weight of the utensil itself to keep it in place, or on a frictional fit caused by slightly deforming the utensil by forcing it in between structural members of the rack. In the case of extremely lightweight and/or fragile utensils made of very thin material, wedging them in between structural members of the dish rack in this manner is generally undesirable since the frictional forces required to hold the utensil in place in the rack are usually also damaging to the utensil itself. In fact, many utensils made of this plastic material are cracked and destroyed in this process.

Another method of keeping utensils in place has been to form an enclosure which substantially or entirely surrounds the utensils. Such an enclosure can be formed as a separate unit and be placed into the dish rack, or may be made as an integral part of the dish rack itself. When jets of water are directed into the enclosure, the utensils therein have a much more limited range of movement. This method of securing utensils is still, however, less than satisfactory in that the are of the dish rack which is completely enclosed is usually predetermined (i.e., determined by the dish rack or enclosure manufacturer, and not by the consumer) and generally quite limited. Also, utensils placed in the enclosure are generally not completely immobilized and can still flip over or be damaged even when contained therein.

Another method of securing utensils in a dish rack has been to place a net over the entire rack opening, or a portion thereof. Utensils covered by the net are again limited in their range of movement. However, the relative immobilization of any one utensil depends to a substantial degree on the number of other utensils adjacent thereto in the rack and the limited area of movement allowed it by these other utensils. Also, movement is not completely inhibited, and as a result, flipping over and/or damage can still result.

In light of the noted disadvantages of the prior art methods of securing utensils in a dish rack, there continues to exist a need for a device which can securely hold utensils regardless of the number or size thereof in the rack, and regardless of the weight or strength thereof, in such a manner that movement is substantially prevented during the cleaning, drying and/or storing of utensils in the rack, and in such a manner that damage to relatively fragile utensils is avoided.

SUMMARY OF THE INVENTION

It is an object of the present invention to provide a device which can securely hold objects in a container.

It is another object of the invention to provide a device which can prevent a jet of water or air generated by dishwashing machines from displacing utensils therein.

It is further an object of the present invention to provide a device as described above which also avoids damaging the utensils.

The above and other objects of the invention are realized in a specific illustrative embodiment of a flexible dishwasher accessory which includes at least one elongate flexible cord having attachment members on each end thereof which allow attachment of the flexible cord or cords to a rack or other similar container, thereby allowing the cord or cords to secure objects such as eating and cooking utensils therein while they are being washed, rinsed, dried or stored.

In accordance with one aspect of the invention, the attachment members comprise openings which allow the cord or cords to pass therethrough and securely fastened thereon, and further comprises hooks which allow for the attachment members to be removably fastened to the rack.

In accordance with another aspect of the invention, the attachment members include notches which allow them to be fastened directly to the rack without the use of hooks.

BRIEF DESCRIPTION OF THE DRAWINGS

The above and other objects, features and advantages of the invention will become apparent from a consideration of the following detailed description presented in connection with the accompanying drawings in which.

DETAILED DESCRIPTION OF THE INVENTION

Figure 1:
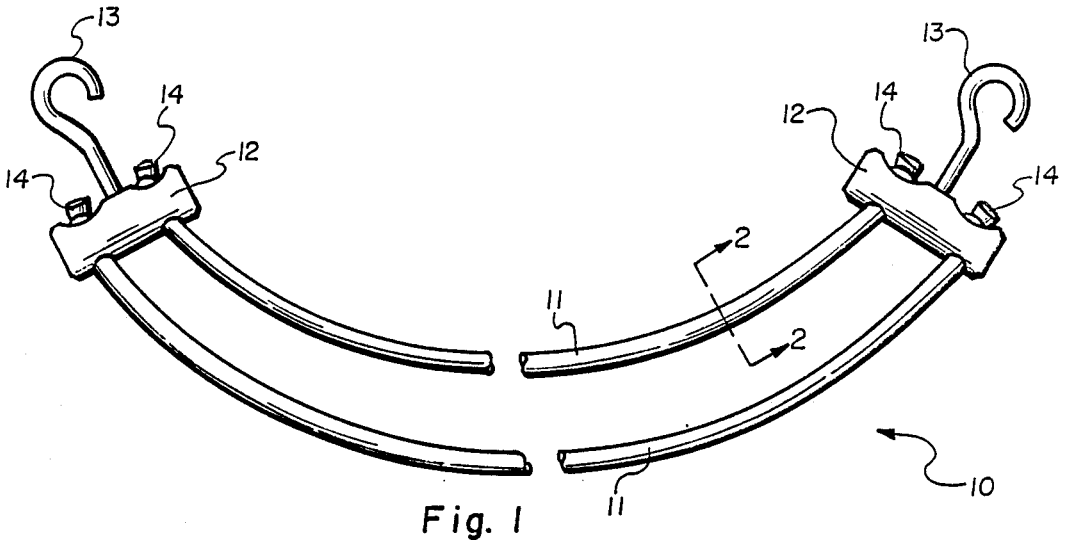
FIG. 1 is a perspective view of a preferred embodiment of the invention.

Referring to FIG. 1, there is shown a flexible dishwashing accessory 10 having a pair of flexible cords 11 which are of approximately equal length. Cords 11 each comprise ends 14 which are attached to attachment member 12 such that one end 14 of each cord 11 is attached to an attachment member 12 a spaced-apart distance from the end of the other cord 11. Hook member 13 extends from the central portion of attachment member 12 and lies in generally the same plane as the cords 11.

Figure 2:
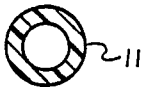
FIG. 2 is a cross-sectional view of the invention taken along line 2—2 of FIG. 1.

Flexible cord 11, as shown in FIG. 2, is formed of a tubular elastomeric material, preferably silicon tubing, which is substantially unaffected by hot water, steam, detergent, or other conditions it may be subjected to in the interior of an automatic dishwasher. The surface of cord 11 is formed to have relatively good adhesion against glass, metal, plastic or other common materials used in eating and/or cooking utensils. Further, the elastomeric material of the cords 11 is also resistant to notching or scratching which could ultimately lead to tearing, breaking, or other failure of the cord 11.

The cords 11 may also be made of a solid elastomeric member, and need not necessarily be tubular in cross-section, e.g. they may have a rectangular, square or triangular cross-section.

Figure 3:
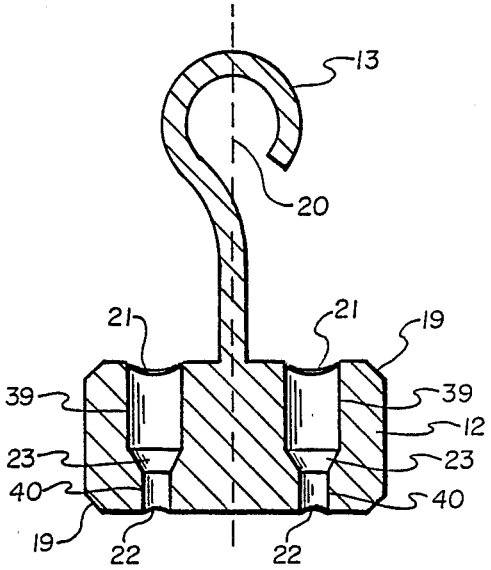
FIG. 3 is a cross-sectional view of the attachment and hook portion of the invention.

FIG. 3 shows a cross-sectional view of the attachment member 12 and hook 13. Attachment member 12 is generally cylindrical in shape having tapers 19 at the ends thereof. Hook member 13 is located directly in the center of the cylindrical surface of attachment member 12 and extends outwardly therefrom in a radial direction. As is illustrated by hatched line 20, hook 13 extends directly away from attachment member 12 in a normal direction, and is formed such that any forces placed on the hook 13 by a member placed in the eye thereof, will tend to pull in a direction normal to the attachment member 12 thus preventing the creation of a rotational moment therein which would tend to cause an uneven tension in the flexible cords 11.

Attachment member 12 also comprises a pair of openings extending through the diameter thereof, each opening located an equivalent distance away from, and in the same plane as, the hook 13. Each of these openings comprises a large bore 39 and a small bore 40. Large bore 39 opens at one of its ends to the exterior surface of member 12, and includes taper 21 at the opening. Small bore 40 also opens to the exterior surface of member 12 and includes tapered area 22 thereat. The interior ends of large bore 39 and small bore 40 ar connected by intermediate bore 23 which has a diameter which gradually changes in a smoothly tapering manner.

Figure 4:
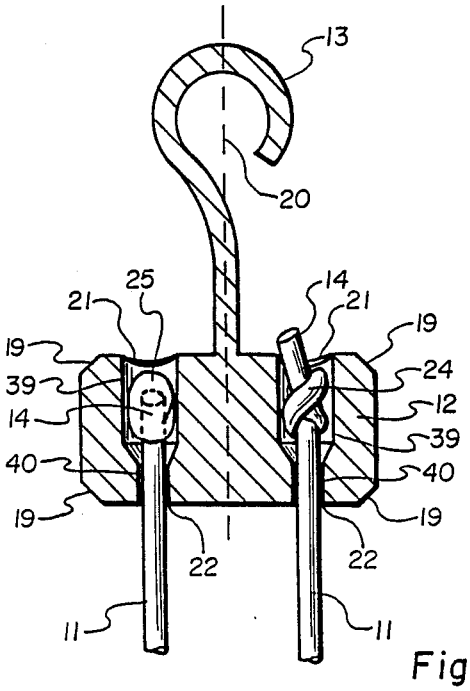
FIG. 4 is the cross-sectional view shown in FIG. 3 having added thereto a perspective view of the flexible cord of the invention.

As shown in FIG. 4, flexible cords 11 have an outer diameter which matches the diameter of small bore 40. The flexible cords 11 pass through small bore 40 into large bore 39, and are prevented from being extracted back through small bore 40 by a knot 24 in the end 14 thereof, or by a globule of elastomeric material 25. Any elastomeric material capable of being securely fixed to end 14 which results in an effective diameter larger than the diameter of small bore 40 may be used to seal the end 14 into large bore 39.

Although hook member 13 is shown to be integrally formed with attachment member 12, it is anticipated that hook 13 be alternatively formed separately from attachment member 12 and then securely fastened thereto by means of threads, bolts, etc. Hook 13 may also be rotatably attached to attachment member 12, thus allowing the eye of hook 13 to be located in any desired plane relative thereto depending on the structure to which is to be attached. (For example, as shown in FIG. 5, hook 13 may have its eye portion resting in a plane perpendicular to the longitudinal axis of attachment member 12.)

Figure 5:
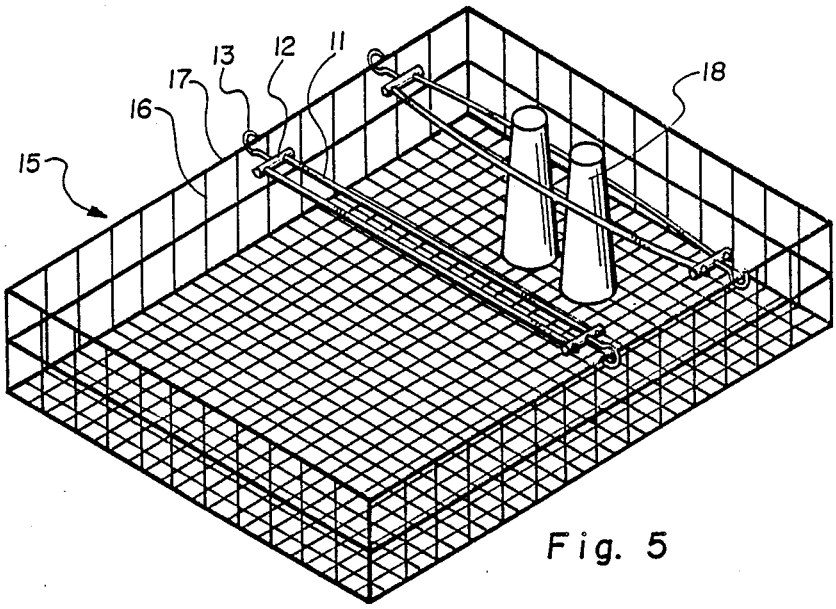
FIG. 5 is a perspective view of a dish rack showing one intended use of the invention.

As also shown in FIG. 5, the flexible dishwashing accessory 10 is stretched across a well-known type dish rack 15 used in commercial automatic dishwashers or in automatic dishwashers designed for home use. Rack 15 is made of wire or plastic mesh having a plurality of vertical framing members 16 and a horizontal framing member 17. The dishwashing accessory 10 is stretched across the rack 15 and attached by means of hook 13 to either the vertical or the horizontal framing members 16 or 17 respectively.

An accessory 10 thus placed can then be used to secure eating utensils such as glasses 18. The flexible cords 11 are spread apart slightly to allow the glass 18 to be placed therebetween, then when the cords 11 are released, they securely grip against the sides of the glass 18 holding it in place in the rack 15. The support for the glasses 18 given by the flexible cords 11 aid the glass 18 in remaining stationary while being subjected to the high velocity and multidirectional sprays of water and/or air generated in a normal cleaning cycle of an automatic dishwasher. Although only glasses 18 are shown to be securable by the accessory 10, any cooking or eating utensil may be secured by placing it between and/or under the flexible cords 11. As can be seen, the accessory 10 is very useful for securing fragile or lightweight eating and/or cooking utensils which generally tend to be displaced, or even tossed about and damaged inside the dishwasher during a cleaning cycle.

Figure 6:
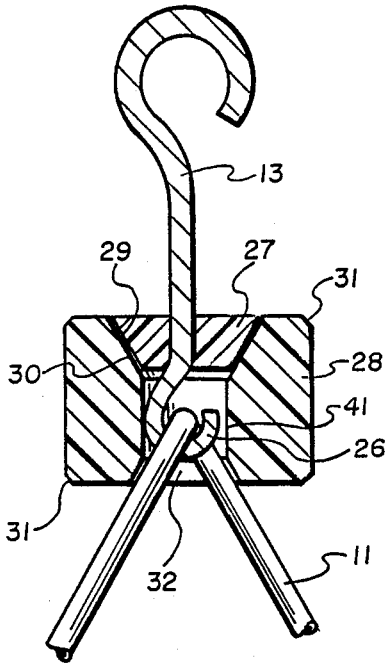
FIG. 6 shows a second preferred embodiment of the invention having the hook and attachment portions shown in cross-section, and the flexible cord shown in perspective.

FIG. 6 shows a second preferred embodiment of the present invention having a hook 13 for attachment to a framing member of a dish rack, and a hook 26 for attachment to a flexible cord 11. Hook 13 and hook 26 can be made of one continuous piece of material as shown in the drawing, or may be made separately. Plug member 27 is located in between hook 13 and hook 26 and is securely attached thereto either by means of adhesive or by being formed as an integral unit therewith.

Plug 27 is generally conical in shape with its diameter gradually decreasing in the direction of the hook 26. Attachment member 28 is generally cylindrical in shape and has a bore 41 extending therethrough which comprises taper 32 at one opening thereof and taper 30 at the other opening thereof. Taper 30 being sized to conform with the shape of surface 29 of plug member 27. Attachment member 28 also comprises beveled edges 31.

As can be readily seen by those of ordinary skill in the art, the embodiment shown in FIG. 6 allows the flexible dishwashing accessory to be assembled with one continuous piece of flexible cord 11, thus alleviating the need for knotting or otherwise securing ends 14 of the cord 11 in the attachment member. Instead, this embodiment allows cord 11 to be held in place by its attachment in the eye of hook 26. The cord is prevented from being pulled from the attachment member 28 by means of plug 27.

Figure 7:
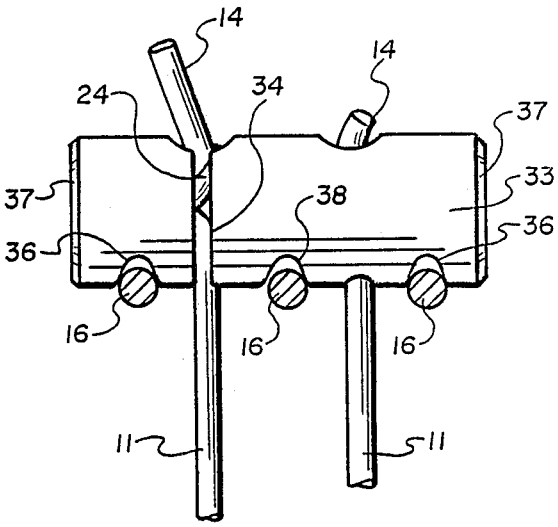
FIG. 7 is a perspective view of a third preferred embodiment of the invention.

FIG. 7 shows a third preferred embodiment of the invention having an attachment member 33 which is generally cylindrical in shape and which has openings therethrough which are identical to the openings in attachment member 12 as shown in FIG. 3. The embodiment of FIG. 7 differs from the embodiment of FIG. 4 in that it has no hook 13. Instead, notches 36 and 38 are placed in the exterior surface of attachment member 33 to perform substantially the same function, i.e., to secure the attachment member 33 to a rack such as rack 15 of FIG. 5.

Notches 36 and 38 are sized to accept the vertical framing members 16 of the rack 15, and are located on attachment member 33 in the same plane as cords 11 in order to prevent a rotational moment being generated therein by the forces of attachment to rack 15. Notches 36 and notch 38 may be used together on a single attachment member 33, or may be used separately. For example, notches 36 may be used to support attachment member 33 on vertical framing member 16 without the use of notch 38 or the presence of a framing member 16 at the location of notch 38. Or vice versa, notch 38 may be used to hold the attachment member 33 securely against framing member 16 without the presence of notches 36 or the shown framing member 16 at the location of notches 36.

If, however, notch 38 is used, a slot 34 may advantageously be located in at least one of the openings of attachment member 12 which secure a flexible cord 11 thereto to form an open channel extending the entire length of the attachment member opening. The slot 34 then allows cord 11 to be detached from attachment member 33 to allow placement of a vertical framing member 16 therebetween and into notch 38. The cord 11 can then be reattached by sliding it through slot 34. An extended end 14' of cord 11 may also be formed to allow for gripping thereof and for easy detachment and reattachment of the cord 11.

Figure 8:
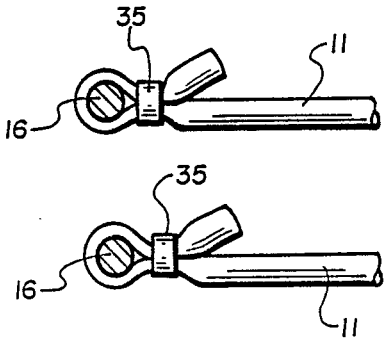
FIG. 8 is a perspective view of a fourth preferred embodiment of the invention.

FIG. 8 shows a fourth preferred embodiment of the present invention which includes an attachment member 35 which secures flexible cord 11 around a framing member such as vertical framing member 16 or horizontal framing member 17. The attachment member 35 may be used to permanently attach cord 11 to the framing member, or may be securely fastened to one portion of cord 11 and be detachably fastened such as in the manner shown in FIG. 7 to the other portion of cord 11.

Although each of the preferred embodiments in the invention show a pair of flexible cords 11 extending from each of two attachment members, it is contemplated that any number of cords 11 be extendable therebetween. Also, the attachment members and hook members may be made of any material such as metal or plastic, and may be integrally formed or assembled from separately formed pieces. The preferred material being nylon and/or stainless steel.

Also, although the accessory 10 may be sized to be used in any type of rack similar to rack 15, it is preferred that the overall length of the accessory 10 be in the range of 6 to 18 inches and preferably in the range of 11 to 13 inches, and the diameter of the flexible cord 11 be in the range of 1/16 to ¼ of an inch, preferably ⅛ inch, and the diameter of the attachment member in the range of ½ inch to ¼ inch, preferably ⅜ inch, with a length of between ½ inch and 4 inches, preferably 1 inch.

The hook 13 is of a length of between 1 inch and 4 inches, preferably 1½ inches, and the eye of hook 13 is of a size sufficient to allow it to be attached to dish rack framing members having a diameter between ⅛ inch and ½ inch.

It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modification and arrangements.

What is claimed is:

1. An accessory for use with a container such as a rack for eating and cooking utensils, said accessory comprising elongate flexible securing means including a plurality of flexible securing members having end means, and means for removably attaching said flexible securing means to the container, said attaching means including a plurality of attachment members, each of which is connected to said securing means at said end means, said attachment members including a plurality of hooks, at least one of said hooks being attached to said elongate securing means, and at least one other of said hooks being attachable to the container, each of said attachment members further comprising at least one opening therein forming a conical interior surface, a portion of said elongated securing means being located in said opening, and at least one plug having a truncated conical shape, said plug having at least two of said plurality of hook members rigidly attached thereto, the conical shape of said at least one plug contacting the conical interior surface of said attachment member opening when positioned therein, whereby the portion of said end means of said elongate flexible securing means located in said attachment member opening which is attached to said at least one hook, is prevented from being detached from said at least one hook by said attachment member opening.

2. An accessory according to claim 1 wherein said attachment means comprises a plurality of attachment members connected to said securing means at said end means.

3. An accessory according to claim 2 wherein said attachment members include hook means for removable attachment to a container.

4. An accessory according to claim 2 wherein said attachment members comprise at least one opening therein, said elongate securing means being located in said opening.

5. An accessory according to claim 4 wherein said elongate securing means comprises a plurality of securing members, each securing member being attached to a plurality of said attachment members.

6. An accessory according to claim 5 wherein said attachment members each form a plurality of openings therein, each of said plurality of openings having at least one elongate securing member located therein.

7. An accessory according to claim 6 further comprising hook means associated with each attachment member, said hook means being located between at least two of said plurality of attachment member openings.

8. An accessory according to claim 3 wherein said hook means includes a plurality of hooks, at least one of said hooks being attached to said elongate securing means, and at least one other of said hooks being removably attachable to the container.

9. An accessory according to claim 8 wherein said attachment member further includes a plug and said plurality of said hook members including two hooks, said two hooks being rigidly attached to said plug.

10. An accessory according to claim 7 wherein said attachment member openings are generally cylindrical, each of said openings further comprising a first portion and a second portion, said first portion having a diameter greater than said second portion.

11. An accessory according to claim 10 wherein said first portion of said attachment member opening further comprises a third portion, said third portion connecting said first portion and said second portion, said third portion having a gradually decreasing diameter from its connection with said first portion to its connection with said second portion.

12. An accessory according to claim 11 wherein said elongate securing means further comprises means located in said first portion of said attachment member openings for preventing removal of said elongate securing means therefrom.

13. An accessory for use with a container such as a rack for eating and cooking utensils, said accessory comprising elongate flexible securing means including a plurality of flexible securing members having end means, means for removably attaching said flexible securing means to the container, said attaching means comprising a plurality of attachment members connected to said securing means at said end means, said attachment members each forming plurality of openings therein, hook means associated with each attachment member, said hook means being located between at least two of said plurality of attachment member openings, said attachment member openings being generally cylindrical having a first cylindrical portion connected to a second cylindrical portion by a conical portion, said first cylindrical portion having a diameter greater than said second cylindrical portion, and said attachment member forming a slot located along the entire length of at least one of said attachment member openings which forms an open channel extending the entire length of the attachment member opening from the interior thereof to the exterior of the attachment member, whereby, and end means of an elongate securing means can be removably attached to said attachment member by passing it through said open channel into said attachment member opening.

* * * * *